United States Patent [19]

Desloge

[11] 4,346,287

[45] Aug. 24, 1982

[54] ELECTRIC HEATER AND ASSEMBLY

[75] Inventor: George B. Desloge, St. Louis, Mo.

[73] Assignee: Watlow Electric Manufacturing Company, St. Louis, Mo.

[21] Appl. No.: 148,593

[22] Filed: May 16, 1980

[51] Int. Cl.[3] ..... H05B 3/08

[52] U.S. Cl. ..... 219/541; 219/544; 219/552; 339/136 R; 338/241; 338/242; 338/274; 403/393

[58] Field of Search ..... 219/236, 523, 541, 544, 219/552; 338/238, 239, 240, 241, 242, 273, 274, 302, 270, 321; 174/93, 75 R, 77 R, 84 C; 29/614, 611; 339/136 R, 142; 13/25; 403/393

[56] References Cited

U.S. PATENT DOCUMENTS

| | | | |
|---|---|---|---|
| 2,455,102 | 11/1948 | Temple | 338/240 X |
| 2,831,951 | 4/1958 | Desloge | 338/241 |
| 3,167,736 | 1/1965 | Temple | 338/221 |
| 3,668,598 | 6/1972 | Drugmand et al. | 338/274 |
| 3,839,623 | 10/1974 | Portmann | 219/541 |

*Primary Examiner*—Volodymyr Y. Mayewsky

*Attorney, Agent, or Firm*—Senniger, Powers, Leavitt and Roedel

[57] ABSTRACT

An electrical heater comprising a heating element, a sheath surrounding the heating element and spaced therefrom, the sheath having an end spaced from an end of the heating element, electrical insulation between the heating element and the sheath, an internal lead pin electrically connected to the heating element and extending toward the end of the sheath, an electrically insulating end plug within said sheath at the end thereof and an external lead having an inner terminal. The insulating end plug has an opening in its inner face into which the end of the pin is received, and a hole in its outer face having its centerline offset from the centerline of the pin but laterally bounded in part by a lateral surface of the pin, the hole in the end plug receiving the inner terminal of an external lead. The sheath holds the end plug in a laterally compressed state, whereby the end plug holds the inner terminal and internal lead in engagement with each other to form a lapped connection therebetween interiorly of the insulating end plug. Also disclosed is an oversleeve for the heater and an electrical heater assembly which is at an intermediate stage in the manufacture of a finished electrical heater.

33 Claims, 23 Drawing Figures

ELECTRIC HEATER AND ASSEMBLY

BACKGROUND OF THE INVENTION

This invention relates to the field of electrical resistance heaters, and more particularly to a novel mineral insulated heater having an improved electrical connection for external leads, and a novel method and end adapter useful in the production of such a novel heater.

Mineral insulated, or so-called cartridge, heaters conventionally comprise a resistance element, typically coiled on an insulating core, and a metal sheath that is coaxial with the coil and core and radially spaced from the coil. Filling the space between the sheath and the coil is a mineral insulating material that has an optimum combination of relatively high thermal conductivity and relatively low electrical conductivity. In commercial cartridge heaters, the mineral insulating material is most commonly magnesium oxide. Power is delivered to the heater through lead pins electrically connected to the resistance element and contained within longitudinal bores in the core, each lead pin extending from the core outwardly through an end of the heater. The end terminals of the resistance element extend along the ends of the core and into the longitudinal holes in the core where they are held in electrical contact with the lead pins. Opposite ends of the resistance element are connected to different lead pins so that electrical power can be supplied to the coil. The lead pins are usually solid as opposed to stranded in order to minimize surface area and the detrimental effects of surface oxidation. They are also reasonably rigid so as to be easily assembled. Heaters of this type are described, for example, in Desloge U.S. Pat. No. 2,831,951 and Portmann U.S. Pat. No. 3,839,623.

In conventional cartridge heaters, each internal lead pin extends outwardly from an end of the heater with the outward extension of the lead pin being adapted to be electrically connected to an external lead. Because the internal lead pins are rigid, the electrical connections between the internal lead pins and the external leads occupy a relatively large amount of space at the end of the heater which adds to the "unheated" length of the cartridge heater. Additional "unheated" length is undesirable in that it acts as a heat sink, causes an uneven heat flux and temperature distribution along the length of the heater, reduces the wattage output of the heater in those applications where the length of the heater is limited and prevents use of the heater in certain close quarters applications. Moreover, by being exposed at the end of the heater, such electrical connections are vulnerable to abuse and damage. While enclosures for the connections such as those shown in Portmann have been used, the enclosures add additional "unheated" length to the heater.

The electrical connections between the external leads and the lead pins are typically effected by welding, brazing, or via an upset of clinched mechanical link. None of these means of connection is entirely satisfactory since each is subject to inherent mechanical weakness and, in certain instances, to significant voltage drop and heat generation across the connection. Specifically, the process of making welded or brazed connections adversely heats the constituent materials and, where fluxes are introduced, misuse of these fluxes can cause electrical shorting since the fluxes are conductive.

Crimping and other mechanical joints require additional "unheated" length to accomodate the joint.

SUMMARY OF THE INVENTION

Among the several objects of the present invention, therefore, may be noted the provision of a novel electrical heater which has an electrical connection between an external lead and an internal lead pin exhibiting a minimum contact voltage drop; the provision of such a heater which utilizes a lapped connection; the provision of such a heater which is relatively invulnerable to deterioration through oxidation of contact surfaces or otherwise; the provision of such a heater in which the connection between an external lead and internal lead pin is more mechanically secure yet of lower cost than the prior art connections; the provision of such a heater in which an insulation jacket on the external lead is mechanically secured to the heater for strain relief; the provision of such a heater in which the external lead may be contained in a conduit secured to the heater; the provision of such a heater which avoids the weaknesses and expense of welded, brazed, upset or clinched connections between an external lead and an internal lead pin; the provision of such a heater in which the external lead may be completely flexible and may extend at right angles from the axis of the heater; the provision of such a heater in which the unheated length is minimized; the provision of such a heater which has improved life characteristics; the provision of such a heater which experiences a low rate of transmission of vapor into the interior thereof, thereby limiting inward flow of oxygen; the provision of such a heater which has a tightly closed lead end with no exposed wires or pins and which prevents the introduction of contaminants that could cause electrical shorting; and the provision of such a heater which is of simpler and more economical construction than the prior art electrical heaters.

Further objects of the invention include the provision of a method for preparation of a cartridge heater, and optionally an end adapter for use in such preparation, which provide an electrical heater having the above noted advantageous features; the provision of such method and end adapter which are useful to produce a simple, durable electrical connection; the provision of such a method and adapter which afford economical manufacture of an electrical heater having the above noted characteristics; and the provision of such a method and end adapter which allow the heater to be manufactured without its external leads and thereafter stored for extended periods before the external leads are connected to the internal lead pins in preparation for use.

Still further objects of the invention include the provision of a novel apparatus for preparing inserts of compactible material for the end adapters of the invention; and the provision of such apparatus for producing the end adapters.

Briefly therefore, the present invention is directed to an electrical heater comprising a heating element, a sheath surrounding said heating element and spaced therefrom, said sheath having an end spaced from an end of the heating element, an internal lead pin extending toward said end of the sheath, and an insulating end plug within said sheath at said end thereof. The insulating end plug has an opening in its inner face into which the outer end of said pin is received, and a hole in its outer face having its centerline offset from the centerline of said pin but laterally bounded in part by a lateral surface of said pin, and being so sized in cross section as to afford closely fitting accomodation for an inner terminal of an external lead. The insulating end plug and the portion of the sheath around it are adapted to be permanently deformed to a reduced cross sectional area upon being laterally compressed, whereby a lapped connection may be made between said inner terminal and said internal lead pin interiorly of the insulating end plug upon the reduction of the cross sectional area of said insulating end plug and the resultant reduction of the cross sectional area of said hole in said insulating end plug.

The invention is further disclosed to an end adapter for an electrical heater effective for facilitating connection of an external lead to an internal lead pin in an insulating end plug in the heater at an end of the heater, said insulating end plug having a hole therein for the inner terminal of the external lead, the hole having its center line offset from the center line of said pin but laterally bounded in part by a lateral surface of the pin, and being so sized as to afford closely fitting accomodation for the inner terminal of the external lead. The end adapter comprises a tubular member open at its ends constituting an oversleeve adapted to be telescoped on said end of the heater, the tubular member being adapted to be permanently deformed to a reduced cross sectional area upon being laterally compressed, whereby the oversleeve is secured to the heater and the insulating end plug is reduced in cross sectional area to effect a lapped connection between said inner terminal and said internal lead pin interiorly of the insulating end plug upon the reduction of the cross sectional area of said oversleeve.

The invention is still further directed to a method of attaching an external lead to an electrical heater interiorly of the heater, said heater comprising a heating element, a sheath surrounding said heating element and spaced therefrom, said sheath having an end spaced from an end of the heating element, and an internal lead pin extending toward said end of the sheath. The method comprises the step of providing an insulating end plug within said sheath at said end thereof, said plug having an opening in its inner face into which the outer end of said pin is received, and a hole in its outer face having its centerline offset from the centerline of said pin but laterally bounded in part by a lateral surface of said pin, and being of such dimensions as to afford closely fitting accomodations for an inner terminal of an external lead. The insulating end plug and the portion of the sheath around it are adapted to be permanently deformed to a reduced cross sectional area upon being laterally compressed. The method further comprises the steps of inserting the external leads in the holes in the end plug and laterally compressing the sheath to reduce the cross sectional area of the insulating end plug and the hole therein, whereby a lapped connection may be made between said inner terminal and said internal lead pin interiorly of the insulating end plug.

Further included in the invention is a method for preparing an end adapter for an electrical heater. In this method a slug of compressible material is prepared and aligned with the axis an oversleeve. The slug is radially compressed to produce a compressed slug having dimensions slightly larger than the interior diameter of the oversleeve. The compressed slug is punched to form an insert and the insert introduced into the tube.

Also included in the invention is a punch and die set adapted for use in making the end adapter of the invention. The set of dies comprises a stationary die member and two movable die members that cooperate to compress the slug and position it over an opening in the stationary die having a shouldered portion. The punch is movable down in alignment with the opening for punching an insert from the slug and transferring the insert into an oversleeve of the end adapter held beneath the shouldered portion of the opening.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
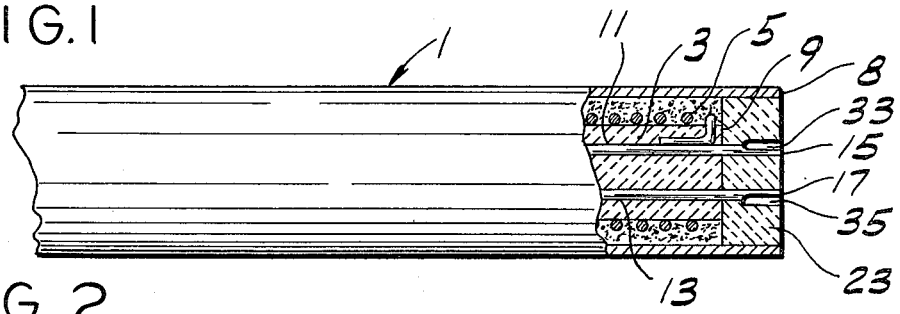
FIG. 1 is a side elevation of an electrical heater of the invention with parts in section to better illustrate the sheath, the internal lead pin, and the insulating end plug.
Figure 2:
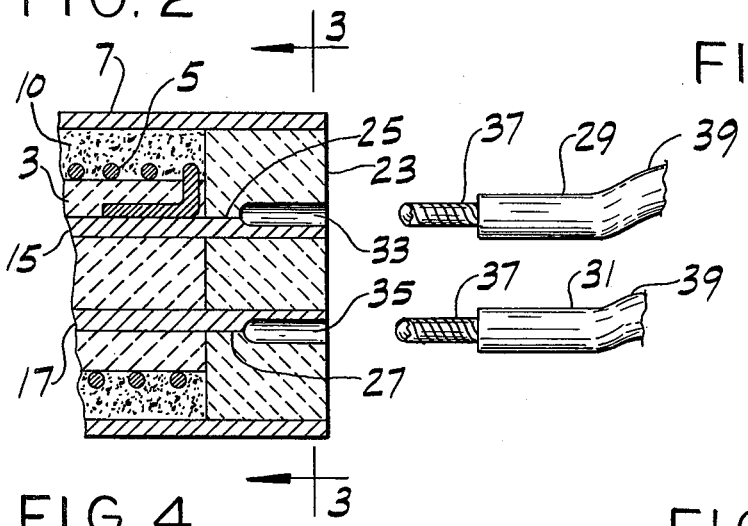
FIG. 2 is an enlarged section view of the end of the heater showing the holes in the outer face of the insulating end plug and the external leads.

Referring to FIGS. 1–4, an electrical heater of the invention, generally indicated at 1, is shown to include a ceramic core 3 around which is wrapped a helical heating coil 5. Surrounding the heating coil and radially spaced therefrom is a metal sheath 7 which extends to an end 8 spaced from an end 9 of the core 3. In the space between the coil 5 and the sheath 7 is a particulate electrically insulating material 10 such as, for example, magnesium oxide. In core 3 are two longitudinal holes 11 and 13 which contain metal power lead pins 15 and 17 respectively. An end of the coil 5 extends through a groove in an end 9 of core 3, and into hole 11 where it is in electrical contact with lead pin 15. Lead pin 17 is similarly connected to the other end of coil 5 at the opposite end of the coil.

Figure 3:
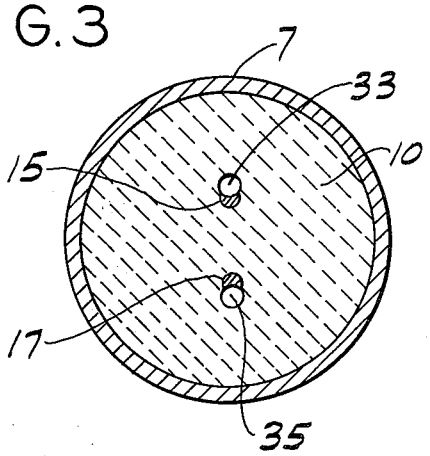
FIG. 3 is a section on line 3—3 of FIG. 2 showing the holes as being laterally bounded by a lateral surface of the pins.
Figure 4:
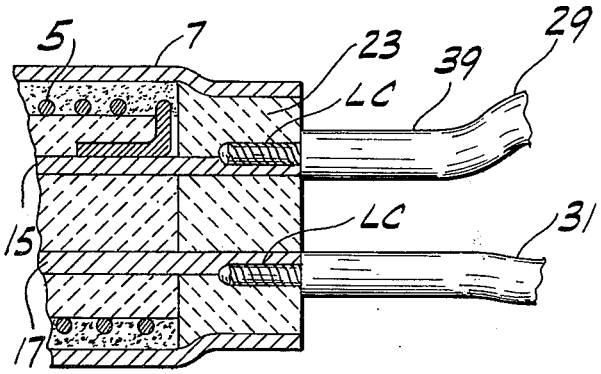
FIG. 4 is a view similar to FIG. 2 but with the external leads inserted in the holes and the heater reduced in cross section area to effect the lapped connections between the external leads and the pins.

An internal electrically insulating end plug 23 fills the space between the outer end 9 of the core 3 and the outer end 8 of the sheath 7 and serves to retain the insulating material 10 within the sheath 7. Openings 25 and 27 in plug 23 are aligned with holes 11 and 13 respectively in the core 3, and the internal lead pins 15 and 17 extend therethrough and are coterminous (i.e., flush) with the outer end or face of plug 23. In accordance with ths invention, the electrical heater 1 is adapted for attachment thereto of external lead, such as external leads 29, 31 shown in FIG. 2, interiorly of the heater. To enable such attachment, holes 33 and 35 are made, as by drilling, in the outer face of the plug 23, each hole having its centerline offset from the centerline of the respective pin but laterally bounded by the pin, and being so sized in cross section as to afford closely fitting accomodation for an inner terminal 37 of the external leads 29, 31. As shown in FIG. 3, the drilling is perferably done at such location on the end plug and to such depth that a portion of the respective pin 15, 17 is removed so that the inner terminal 37 of the external lead is received in the hole in overlapping relation with the internal lead pin. The insulating end plug 23 and the portion of the sheath around it are adapted to be permanently deformed to a reduced cross sectional area upon being laterally compressed such as by swaging or other diameter reduction operations. With the inner terminals 37 of the external leads 29, 31 in the holes 33, 35 and upon the reduction of the cross sectional area of the insulating end plug 23 and the resultant reduction of the cross sectional of the holes a lapped connection LC may be made between the inner terminals and the internal lead pins interiorly of the insulating end plug. Moreover, since the centerlines of each opening (25, 27) for the lead pins and its respective hole (33, 35) for the external leads lie in a central longitudinal plane of the heater and thus in a plane of action of the compressive force applied to the heater, the lead pins and external leads are held in current transmitting engagement with each other in radial orientation with respect to the heater to form the lapped connections. Such lapped connections are advantageous in that they are relatively short (e.g., approximately $\frac{1}{8}$ inch long) thereby minimizing the "unheated" length of the heater 1, are of low electrical resistance, and are sealed, at least in part, by the insulation end plug 23 so as to prevent oxidation of the connection. Thus, the lapped connection of this invention overcomes many problems of the external electrical connections of the prior art heater, yet may be made more easily and more economically than the prior art connections as described more fully hereinafter. Moreover, the lapped connections enable attachment of the external leads and the end adapters to the heater to meet specific customer demands after manufacturer of the basic heater 1, and to do so with a minimum of manufacturing steps.

Typically, the external leads are of stranded wire construction and have insulation jackets 39 which may be made of fabric or of a synthetic material molded or extruded around the wire. To faciliate the entry of the inner terminal of an external lead of stranded wire, such as the leads shown in FIG. 2, into the holes 33,35 in the insulation end of the plug 23, the end of the inner terminal may be fused to form a solid mass of metal at the end of the lead preventing fraying of the strands. The insulation end plug 23 is preferably formed of a refractory material which has mechanical strength in the compressed state sufficient that the insulating end plug retains its integrity in handling and service, and which is effective in the compacted state to substantially exclude ingress of vapors into the interior of the heater but retains sufficient residual permeability to avoid the development of vacuum conditions in said interior. Lava, mica, asbestos, and crushable ceramic have been found to be satisfactory materials from which the insulating end plug may be made.

Figure 5:
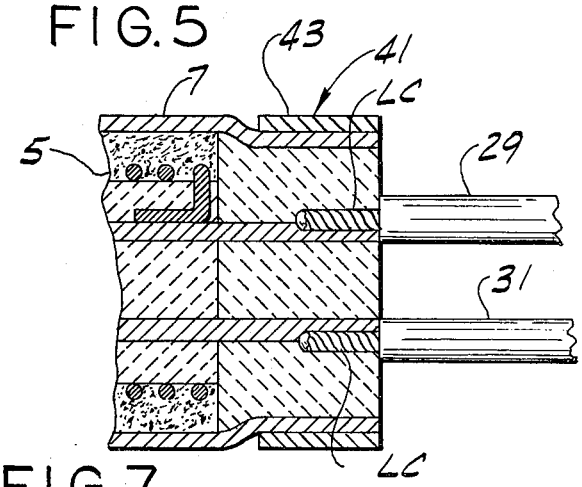
FIG. 5 is a view similar to FIG. 4 but with an end adapter comprising an oversleeve compressed on the heater.

In accordance with this invention, an end adapter generally indicated at 41 in FIG. 5 is provided at the end of the heater 1, the end adapter comprising a tubular member of a suitable material such as stainless steel and open at its ends constituting an oversleeve 43 adapted to be secured to the heater 1 in telescoping relation with the end of the sheath. The oversleeve thus surrounds at least a portion of the end plug, and the lapped portions of the lead pin and the inner terminal of the external lead, and it is adapted to be permanently deformed to a reduced cross sectional area upon being laterally compressed such as by swaging. As shown in FIG. 5, in the swaging operation, the heater and the oversleeve are radially compressed to an external diameter that is substantially uniform along their lengths, and the diameter of the insulating end plug 23, which is surrounded by the oversleeve, is further reduced by an amount corresponding to the thickness of the side wall of the oversleeve to effect greater compaction of the external leads and internal pins at their lapped connections LC.

Figure 6:
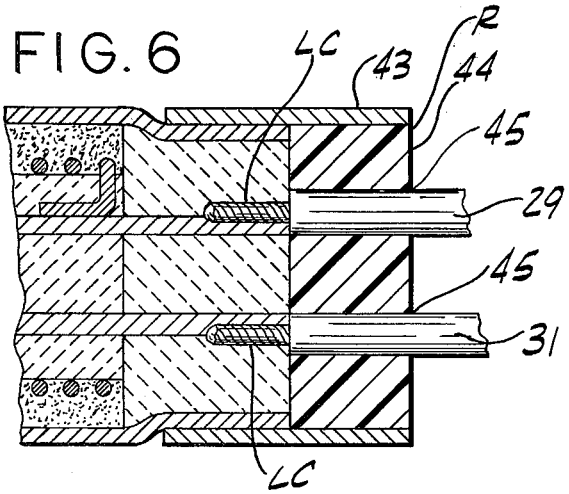
FIG. 6 is a view similar to FIG. 5 but with sealant or an end cap in a recess in the oversleeve.
Figure 7:
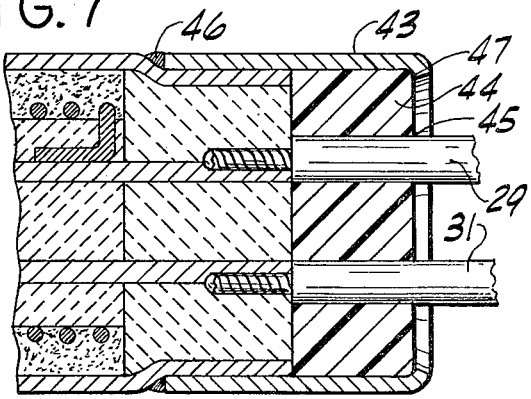
FIG. 7 is a view similar to FIG. 6 but with the oversleeve sealed to the heater sheath and the end of the oversleeve compressed over the end cap.

As shown in FIG. 6, the oversleeve 43 may be positioned on the heater 1 so as to extend beyond the outer face of the insulating end plug a relatively short distance thereby forming a recess R in the oversleeve, and end adapter 41 further comprises an end cap 44 of a suitable material, in the recess in engagement with the insulating end plug. The end cap has holes 45 therein for the external leads 29, 31 and serves to retain the insulating end plug 23 in the sleeve, which retention may be necessary for a material such as lava which is subject to fracture, when compressed. Alternatively, the recess R could be filled with a suitable sealant, also shown in FIG. 6 at 44, such as sealant selected from the group consisting of a fluoroethylene, a silicone rubber, and an epoxy resin. The end plug and sealant also serve to seal the end of the heater to prevent ingress of oxygen or vapors to the lapped connection LC. If a hermetic seal of the lapped connections and the heater is desired, the oversleeve may be secured to the sheath in sealed relationship as by welding at the seam 46, and the end plug may be held in the oversleeve in sealed engagement with the external leads, and with the interior surface of the oversleeve by compressing the end cap 44 in the oversleeve. To retain the end cap in the oversleeve, the edges of the oversleeve may be crimped over the end cap, as shown in FIG. 7.

Figure 8:
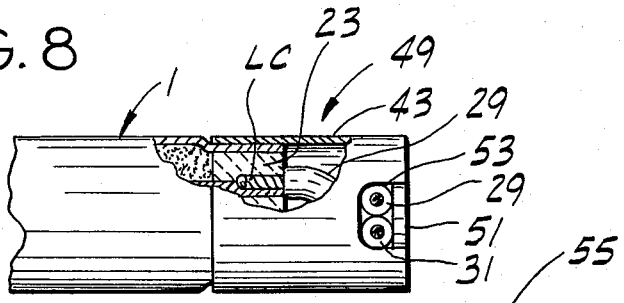
FIG. 8 is a side elevation of an alternative embodiment of the end adapter compressed on the heater with portions broken away to better illustrate the external leads extending laterally from the heater.

An alternative embodiment of the end adapter generally indicated at 49 is shown in FIG. 8. It is similar to the end adapter 41 shown in FIG. 6 except that it has a solid closure plug 51 (i.e., free of holes for the external leads) spaced from the insulating end plug 23, and the side wall of the oversleeve 43 between the insulating end plug and the closure plug has an opening 53 therein for the passage therethrough of the external leads. The external leads 29, 31 which are preferably of stranded wire construction and thus flexible may be lead through the passage 53 and extend laterally of the heater. While the end adapter 49 adds greater "unheated" length to the heater 1 than the end adapter 41, the end adapter 49 occupies less space than the prior art exterior connections, particularly those in which the external leads extend laterally from the heater.

Figure 9:
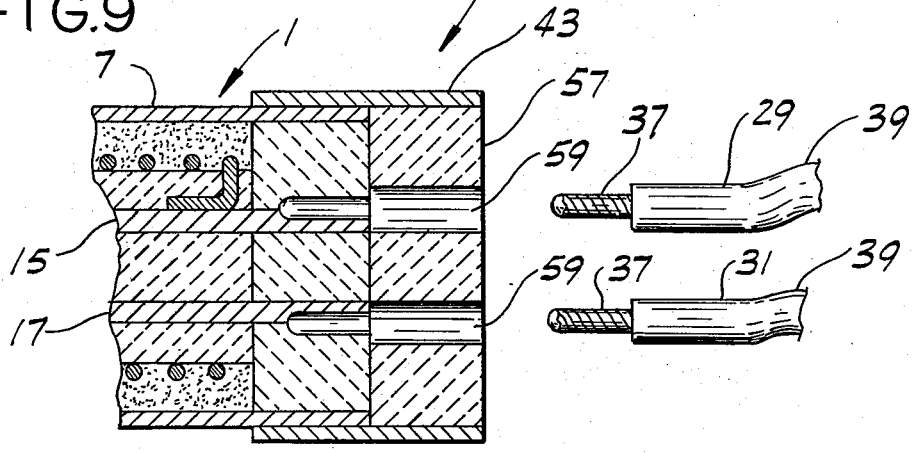
FIG. 9 is a further alternative embodiment of an end adapter on the heater showing a securing insert in the oversleeve.
Figure 10:
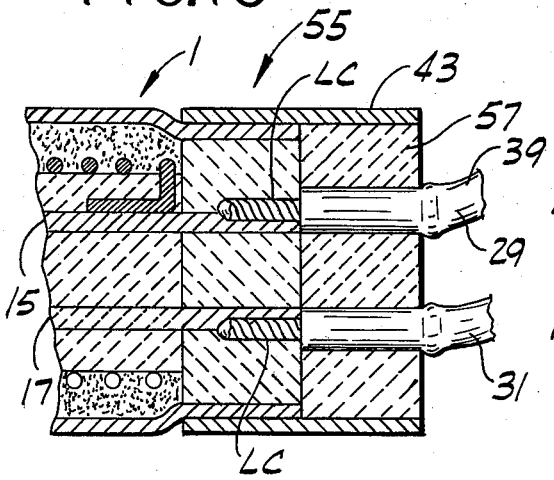
FIG. 10 is a section similar to FIG. 9 but showing the end adapter reduced in cross sectional area to effect the lapped connection between the external leads and the internal pins and gripping of the external leads by the securing insert.
Figure 11:
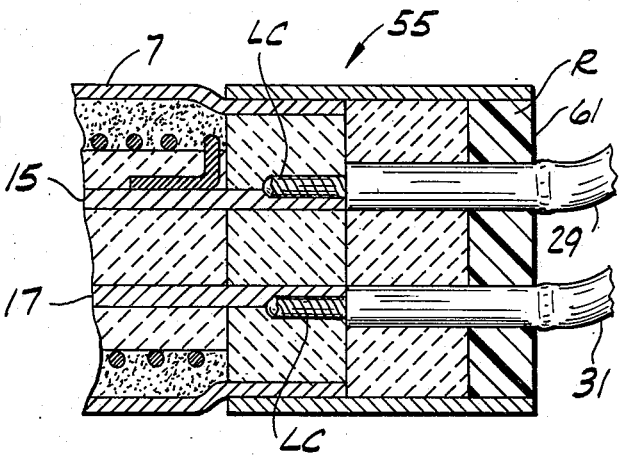
FIG. 11 is a section similar to FIG. 10 but with sealant or an end cap in a recess in the oversleeve.

Referring to FIGS. 9–10, there is generally indicated at 55 a further alternative embodiment of the end adapter of this invention comprising an oversleeve 43 and means such as a securing insert 57 in the oversleeve for securing the external lead to the oversleeve and thus to the heater, thereby providing strain relief for the external leads and electrically insulating the external leads from each other and the oversleeve. The securing insert, which may be made of the same materials as the insulating end plug 23, has holes 59 therein for the external leads 29, 31, and is adapted, as shown in FIG. 10, to be deformed to reduce cross sectional area upon being laterally compressed. With the oversleeve pressed on the heater, the cross sectional areas of the holes 59 in the securing insert 57 are reduced so that the securing insert grips the external leads, and more particularly the insulating sleeve 39 on the external leads. As shown in FIG. 11, the oversleeve 43 of the end adapter 55 may extend so as to form a recess R in the oversleeve and the recess may be filled with an end cap or a sealant, both indicated at 61 in FIG. 11, which may be of the same materials as the end cap and sealant 44 for the end adapter 41.

Figure 12:
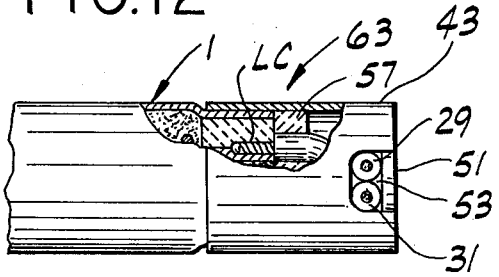
FIG. 12 is a side elevation of a further alternative embodiment of the end adapter compressed on the heater with portions broken away to better illustrate the external leads extending laterally from the heater.

A further alternative embodiment of the end adapter, generally indicated at 63, is shown in FIG. 12. It is similar to the end adapter 49 shown in FIG. 8 but has a securing insert 57 in the oversleeve 43 for gripping the external leads and providing strain relief.

Figure 13:
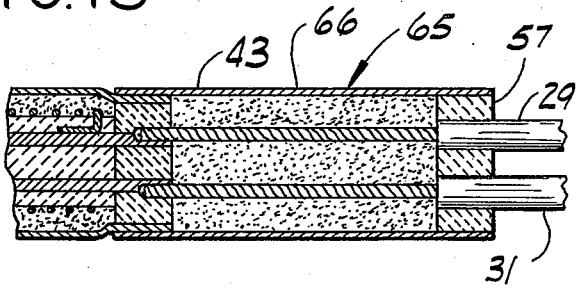
FIG. 13 is a section of yet another alternative embodiment of the end adapter showing insulating material in the end adapter so as to lengthen the end adapter.

A further alternative embodiment of the end adapter, generally indicated at 65, is shown in FIG. 13. It comprises an elongate oversleeve 66, the securing insert 57 being held in the oversleeve 66 spaced from the insulating end plug 23 of the heater thereby defining a space in the oversleeve 66. The space is filled with an insulating material such as a ceramic material which holds the external leads spaced apart and insulated from each other and the oversleeve.

Figure 14:
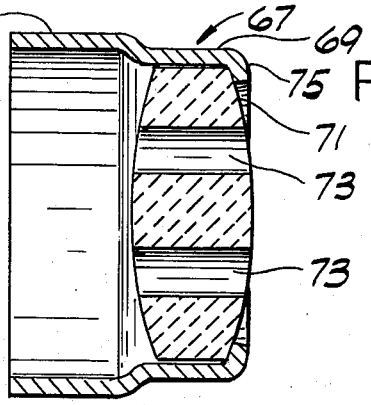
FIG. 14 is a section of yet another alternative embodiment of the end adapter showing an insulating insert in the end adapter.
Figure 15:
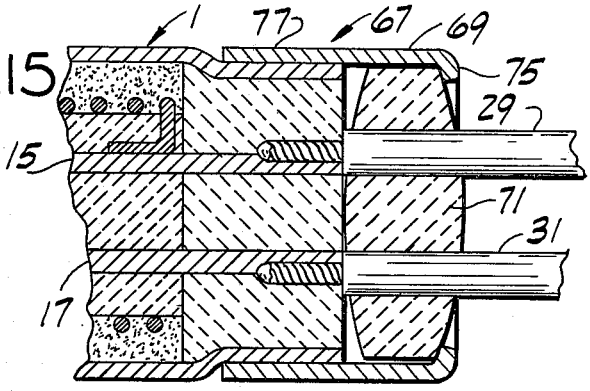
FIG. 15 is a section similar to FIG. 14 but showing the end adapter of FIG. 14 compressed on the end of the heater.

Yet another alternative embodiment of the end adapter, generally indicated at 67, is shown in FIGS. 14 and 15. It comprises an oversleeve 69 and an insulating insert 71 having holes 73 therein for the external leads. The insulating insert is made of a suitable material such as an incompressible ceramic material having good insulating properties. To retain the insulating insert in the oversleeve, the edge of the oversleeve at one end 75 thereof is crimped over the insert 71. The oversleeve at its other end 77 is of increased diameter so as to fit over the heater 1 prior to being laterally compressed. Upon lateral compression of the heater, the end 77 of the oversleeve is reduced in diameter to that of the end 75 of the oversleeve. The insulating insert however, is not compressed during the diameter reduction process.

Figure 16:
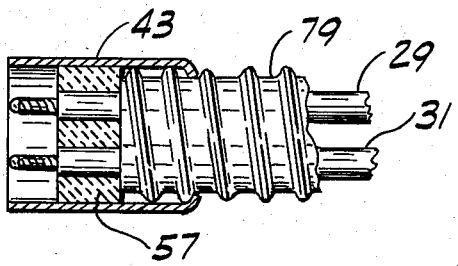
FIG. 16 is a side elevation of a flexible conduit for the external leads secured to an end adapter with some parts broken away and others in section.
Figure 17:
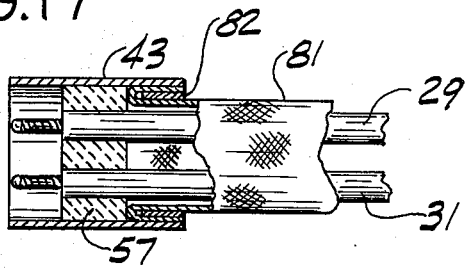
FIG. 17 is a side elevation of a braided conduit for the external head secured to an end adapter with parts shown in section.

As shown in FIGS. 16 and 17, the end adapter of this invention may be utilized for attachment of external leads 29, 31 contained in a conduit or sleeve secured to the heater 1. In FIG. 16, the external leads are contained in a conduit 79 such as flexible, spiral wound, metal conduit, extending within a recess in the end adapter and secured to the end adapter or to a grommet or fitting (not shown) that is in turn secured to the end adapter such as by crimping the edge of the oversleeve 43. In FIG. 17, the external leads are contained in a braided sleeve 81 extending into a recess in the end adapter and secured thereto as by an inner ring 82 in a fold at the end of the sleeve 81 said braided sleeve being secured between the ring 82 and the oversleeve 43 upon compression of the oversleeve as by swaging.

In accordance with the method of this invention of attaching external leads to an electrical heater interiorly of the heater, a heater, such as the prior art heater disclosed in the Desloge and the Portmann patents, which has been subjected to a preliminary swaging operation for laterally compressing its end plug within its sheath and for holding its lead pins in closely fitting accommodation in openings in the end plug and which has its internal lead pins extending from an end of the heater is constructed. This heater may be placed into inventory before the external leads are attached to their respective internal lead pins so as to meet individual customer requirements. Therefore, the end of the heater from which the pins extend is cut off to expose a face of the insulating end plug, and holes are drilled in the outer face of the insulating end plug to form a heater such as the heater 1 shown in FIG. 1. To attach the external leads, the inner terminals 37 of the external leads 29, 31 are inserted in the holes 33, 35 and the end of the heater is laterally compressed as by swaging to reduce the cross sectional area of the heater for effecting the lapped connections LC between the external leads and the internal lead pins. An end adapter of this invention, which may include a securing insert 57, may be placed on the heater and may be laterally compressed to reduce its cross sectional area to that of the heater. The method of this invention thus produces durable electrical connections for an electrical heater having superior properties to the electrical connections of the prior art heaters, and may be performed in a simple, economical manner which minimizes operator error and damage to the heater during handling and storage.

Figure 18A:
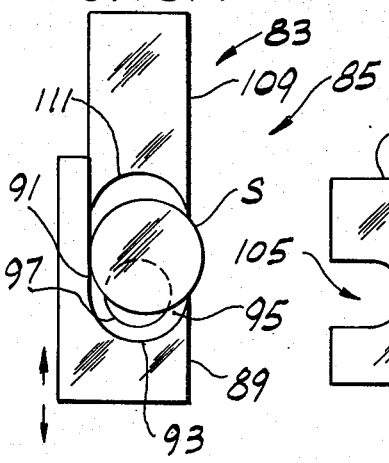
FIG. 18A is a top plan of apparatus for making end adapters for the invention.
Figure 18B:
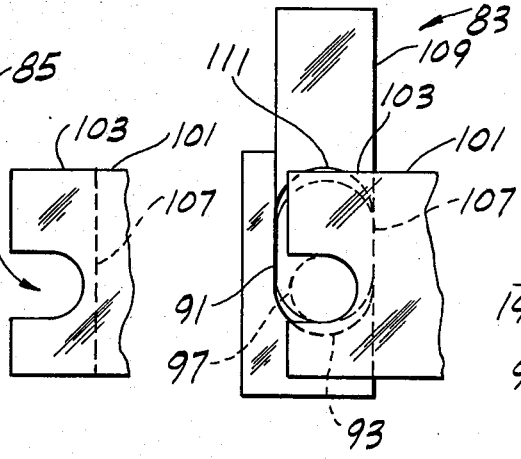
FIG. 18B is a view similar to FIG. 18C showing a first movable die member of the apparatus moved into engagement with a stationary die member of the apparatus to initially compress a slug of compressible material.
Figure 18C:
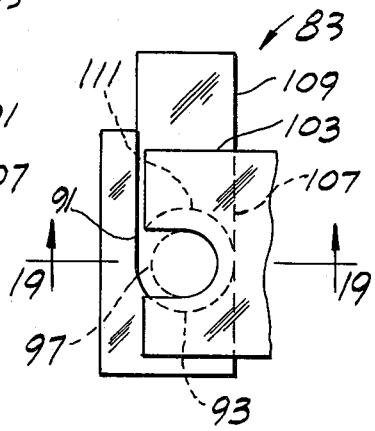
FIG. 18C is a view similar to FIG. 18B showing a second die member of the apparatus in moved position to further compress the slug.
Figure 19A:
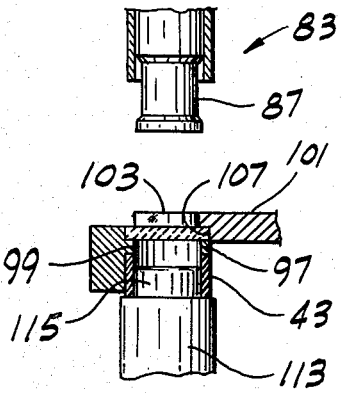
FIG. 19A is a section along line 19—19 of FIG. 18C showing a punch above the compressed slug and a forming ram holding an oversleeve beneath the compressed slug.
Figure 19B:
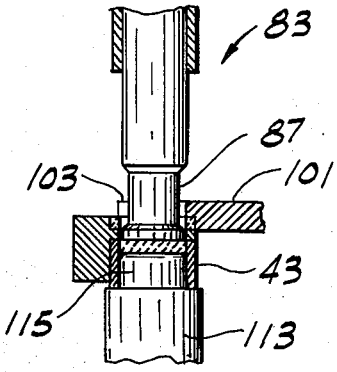
FIG. 19B is a view similar to FIG. 19A but with the punch moved through the slug and the securing insert punched from the slug.
Figure 19C:
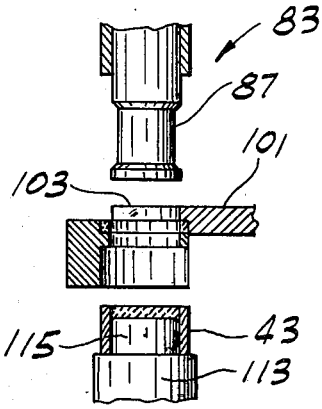
FIG. 19C is a view similar to FIG. 19B but with the punch and forming plunger in retracted positions.

An apparatus, generally indicated at 83, uniquely adapted for producing the end adapter of this invention having a securing insert 57 is shown in FIGS. 18 and 19. The apparatus comprises a set of die members 85 for compressing a slug S of the material from which the securing insert is to be made such as a compressible refractory material (e.g., rolled mica tube) and a punch 87 for cutting the securing insert from the slug S and inserting into the oversleeve 43 of the end adapter. The set of dies comprises a stationary die member 89 having a recess defined by side wall 91, curved end wall 93 and a bottom 95, the bottom having an opening 97 therein having a shouldered portion 99. The apparatus further comprises a first movable die member 101 having a flange 103 with a slot 105 therein adapted to be extended over the stationary die member 89, and a lower side edge 107 adapted to engage the side of the stationary die member 89, and a second movable die member 109 slideable over the bottom 95 of the recess in the stationary die member toward and away from the curved end wall 93 of the recess of the stationary die. The second movable die member having a curved edge 111 facing the curved end wall.

As shown in FIG. 19, the punch 87 is above the die members and is movable down through the slot 105 in the first movable die member 101, between the curved edge 111 of the second movable die member and the curved side wall 93 of the stationary die member, and into the shouldered portion 99 of the opening 97. A forming ram 113 is provided beneath the die members movable between an extended position in which it holds the oversleeve 43 in the opening 97 so as to receive the securing insert 57, and a retracted position in which the end adapter may be removed and another oversleeve 43 loaded onto the ram. The ram has a central raised projection 115 on the end thereof for carrying the oversleeve 43 and for presenting a forming surface against which the plunger can compressing the securing insert 57.

In accordance with the method of this invention, an end adapter having a securing insert 57 is assembled by positioning a slug S on the die members, compressing the slug S, punching the securing insert 57 from the compressed slug, and inserting the securing insert in an oversleeve 43. To compress the slug S which is preferably cylindrical in its uncompressed state, the slug S is positioned on the bottom 95 of the recess of the stationary die member 89, as shown in FIG. 18A, and the first movable die member 101 is moved toward the stationary die member 89 with the lower edge 107 thereof engaging the slug and deforming it into an oval shape as shown in FIG. 18B. The second movable die member 109 is then moved toward the curved end wall 93 of the stationary die member 89 for compressing the slug back into a circular shape, albeit a smaller circle, as shown in FIG. 18C. Thereafter, the punch 87 is driven down to shear the compressed slug at the shouldered portion 99 of the opening 97, to transfer the securing insert 57 into the oversleeve 43 held in the opening by the forming ram 113, and to axially compress the securing insert against the raised projection 115 on the forming ram, as shown in FIGS. 19A and 19B. Upon assembly of the end adapter, the forming ram is moved to retracted position to enable removal of end adapter and placement of an oversleeve on the ram for the next assembly operation. The punch 87 is moved up to enable removal of any remaining slug material on the die members. Thereafter, the movable die members are returned to the positions shown in FIG. 18A for receipt of the next slug S.

Because of its adapability for use with flexible external leads and the relative compactness of the end adapter, the electrical heater 1 of the invention is suited for use in close quarters where rigid leads would not permit the use of conventional heaters having an equivalent heated length. The terminal connection of the heaters of the invention is both mechanically secure and of low contact resistance. Located as they are in the insulating end plug, the lapped connections between the external leads and the internal lead pins are protected from oxidation which can otherwise tend to increase contact resistance during the operative life of the heater. As a result of the relative impermeability of the insulating end plug and the end adapters to oxygen, oxidation of other functional components in the interior of the heater is also minimized. In addition, these element serve as a barrier to contaminets which may otherwise penetrate the heater and have a detrimental effect on heater dielectric strength. In the alternative, and perhaps preferred embodiment of the end adapter, shown in FIGS. 9 and 10, securing of the external lead insulation jackets within the securing insert provides resistance to the pulling away of the insulation from around the conductor where the flexible lead enters the adapter. Retention of the insulation in this manner minimizes the possibility of shorting between the external leads or from the external leads to ground.

By following the steps of the method of the invention an electrical heater having the above advantageous characteristics is reliably and economically produced. Moreover, the method of the invention may be carried out using equipment that is standard in the manufacture of conventional cartridge electric heaters. There is no requirement for extensive retooling or substantial capital investment to adapt a conventional heater manufacturing line for practice of the method of the invention to produce the electric heaters of the invention.

As a further practically beneficial feature, the present invention allows heaters to be manufactured without external leads and then stored. In response to demand, the heaters may be removed from inventory and have a particular end adapter configuration and leads of desired length and type attached prior to use or shipment.

Although illustrated for the attachment of power leads, the contructions described above are equally adapted for the connection of signal leads such as, for example, thermocouple leads. Single or multiple leads of either type may be so attached.

It will further by understood that the invention may be embodied in heaters which contain a heating element of either coiled or other configuration within a sheath, but which do not utilize a core for support of the heating element.

Moreover, while the heater 1 and the end adapters therefor have been shown and described as being generally circular in cross section, it is contemplate that the heater may be of any cross sectional shape including square or rectangular.

In view of the above, it will be seen that the several objects of the invention are achieved and other advantageous results attained.

As various changes could be made in the above constructions and method without departing from the scope of the invention, it is intended that all matter contained in the above description or shown in the accompanying drawings shall be interpreted as illustrative and not in a limiting sense.

What is claimed is:

1. An electrical heater comprising a heating element, a sheath surrounding said heating element and spaced therefrom, said sheath having an end spaced longitudinally from an end of the heating element, electrically insulating means between the heating element and the sheath, an internal lead pin electrically connected to the heating element and extending toward said end of the sheath, an electrically insulating end plug within said sheath at said end thereof having an opening in its inner face into which the outer end of said pin is received, and a hole in its outer face having its centerline offset from the centerline of said pin but laterally bounded in part by a lateral surface of said pin, and an external lead having an inner terminal, the hole in the end plug receiving the inner terminal of the external lead, said lateral surface of the pin being generally complementary in shape to an adjacent portion of the lateral surface of the inner terminal, the sheath holding the end plug in a laterally compressed state, whereby the end plug holds said inner terminal and said internal lead in engagement with each other to form a lapped connection therebetween interiorly of the insulating end plug.

2. An electrical heater as set forth in claim 1 further comprising an end adapter comprising an oversleeve open at its ends secured in telescoping relationship on said end of the sheath.

3. An electrical heater as set forth in claim 2 wherein the oversleeve extends beyond the outer face of said insulating end plug to form a recess in the oversleeve.

4. An electric heater as set forth in claim 3 wherein the recess is filled with a sealant.

5. An electrical heater as set forth in claim 4 wherein the sealant is selected from the group consisting of a fluoroethylene, a silicone rubber, and an epoxy resin.

6. An electrical heater as set forth in claim 3 further comprising an end cap in the recess in the oversleeve in engagement with the outer face of the insulating end plug for retaining the insulating end plug in the heater, the end cap having a hole therethrough adapted to receive an external lead.

7. An electrical heater as set forth in claim 6 wherein the end cap is in sealed engagement with the external lead and the interior surface of the oversleeve, and wherein the oversleeve is secured to the sheath of the heater in sealed relation for hermetically sealing said lapped connection between the external lead and the internal lead pin.

8. An electrical heater as set forth in claim 7 wherein the end cap is of a fluoroethylene.

9. An electrical heater as set forth in claim 3 wherein said end adapter further comprises a closure plug in said recess spaced from the insulation end plug, and has an opening in its side wall between the insulating end plug and the closure plug for passage therethrough of an external lead, whereby said external lead may extend laterally from the heater.

10. An electrical heater as set forth in claim 1 wherein said insulating end plug comprises a refractory material which has mechanical strength in the compressed state sufficient that said insulating end plug retains its integrity in handling and service.

11. An electrical heater as set forth in claim 2 wherein the end adapter further comprises means in the oversleeve for securing the external lead to the oversleeve, whereby strain relief for the external lead is provided.

12. An electrical heater as set forth in claim 11 wherein said securing insert comprises a refractory material which has mechanical strength in the compressed state sufficient that said securing insert retains its integrity in handling and service.

13. An electrical heater as set forth in claim 11 wherein said securing means comprises a securing insert in the oversleeve having a hole therethrough receiving the external lead, said securing insert being held in a laterally compressed state by the oversleeve, whereby the securing insert grips the external lead.

14. An electrical heater as set forth in claim 13 wherein the external lead has an insulation jacket, the securing insert gripping said insulation jacket.

15. An electrical heater as set forth in claim 10 or 12 wherein said refractory material is effective in the compacted state to substantially exclude ingress of oxygen and vapor into the interior of said heater within said sheath but retains sufficient residual permeability to avoid the development of vacuum conditions in said interior.

16. An electrical heater as set forth in claim 15 wherein said refractory material comprises mica.

17. An electrical heater as set forth in claim 13 wherein said oversleeve extends outwardly beyond the outer face of said securing insert to form a recess in the oversleeve.

18. An electrical heater as set forth in claim 17 further comprising an end cap in the recess in the oversleeve in engagement with the outer face of the securing insert, the end cap having a hole therethrough receiving the external lead.

19. An electrical heater as set forth in claim 17 wherein said end adapter further comprises a closure plug in said recess spaced from the securing insert, and has an opening in its side wall between the securing insert and the closure plug for passage therethrough of an external lead, whereby said external lead may extend laterally from the heater.

20. An electrical heater as set forth in claim 17 wherein the recess is filled with a sealant.

21. A electrical heater as set forth in claim 20 wherein the sealant is selected from the group consisting of a fluoroethylene, a silicone rubber, and an epoxy resin.

22. An electrical heater as set forth in claim 13 wherein the inner face of the securing insert is spaced from the outer face of the insulating end plug, said space being filled with insulation.

23. An electrical heater as set forth in claim 22 wherein the insulation is a ceramic material.

24. An electrical heater as set forth in claim 2 wherein the end adapter further comprises an insulating insert in the oversleeve having a hole therethrough adapted to receive an external lead.

25. An electrical heater as set forth in claim 24 wherein the insulating insert is of ceramic material.

26. An electrical heater as set forth in claim 2 wherein the external lead is contained within a flexible conduit secured to said oversleeve.

27. An electrical heater as set forth in claim 2 wherein the external lead is contained in a braided sleeve secured to said oversleeve.

28. An electrical heater as set forth in claim 1 wherein said hole in the insulating end plug is produced by drilling the insulating end plug at a location such that material is removed from a side of said internal lead pin to provide a surface complementary in shape to an adjacent portion of the inner terminal of said external lead, thereby facilitating a mechanically secure, low resistance, easily made, electrical connection between said external lead and said internal lead pin.

29. An electrical heater as set forth in claim 1 wherein said internal lead pin is solid.

30. An electrical heater as set forth in claim 1 wherein the external lead is a stranded wire, the end of the inner terminal of the external lead being fused to facilitate its insertion into the hole in the insulating end plug.

31. An electrical heater comprising a heating element, a sheath surrounding said heating element and spaced therefrom, said sheath having an end spaced longitudinally from an end of the heating element, electrically insulating means between the heating element and the sheath, an internal lead pin electrically connected to the heating element and extending toward said end of the sheath, an electrically insulating end plug within said sheath at said end thereof having an opening in its inner face into which the outer end of said pin is received, and a hole in its outer face having its centerline offset from the centerline of said pin but laterally bounded in part by a lateral surface of said pin, an external lead having an inner terminal received in the hole in the end plug in lapping relation with said lead pin, and a tubular oversleeve mounted on the sheath in telescoping relationship therewith at said end thereof and in surrounding relation with at least a portion of the end plug and the lapped portions of the lead pin and the inner terminal, the heater, including the oversleeve, being laterally compressed to a generally uniform cross sectional area along the length of the heater with the portion of the sheath surrounded by the oversleeve thus being reduced to a smaller cross sectional area than the remainder of the sheath, the oversleeve and the sheath thus holding said portion of the end plug in a laterally compressed state around said lapped portions of the lead pin and the inner terminal, whereby the end plug holds said inner terminal and said internal lead pin in engagement with each other to form a lapped connection therebetween interiorly of the insulating end plug.

32. An electrical heater assembly comprising a heating element, a sheath of permanently deformable material surrounding said heating element and spaced therefrom, said sheath having an end spaced longitudinally from an end of the heating element, electrically insulating means between the heating element and the sheath, an internal lead pin electrically connected to the heating element and extending toward said end of the sheath, an electrically insulating end plug within said sheath at said end thereof having an opening in its inner face into which the outer end of said pin is received in generally closely fitting accommodation, and a hole in its outer face having its centerline offset from the centerline of said pin but laterally bounded in part by a lateral surface of said pin, and an external lead having an inner terminal, the hole in the end plug receiving the inner terminal of the external lead, the centerlines of the opening and the hole in the end plug lying in a central longitudinal plane of the heater and thus in a plane of action of lateral compressive force applied to the heater, the sheath being permanently deformed to a reduced cross sectional area when laterally compressed for holding the end plug in a laterally compressed state, whereby, when the sheath is laterally compressed, the end plug holds said inner terminal and said internal lead pin in engagement with each other in radial orientation with respect to the heater to form a lapped connection therebetween interiorly of the insulating end plug.

33. An electrical heater assembly comprising a heating element, a sheath of permanently deformable material surrounding said heating element and spaced therefrom, said sheath having an end spaced longitudinally from an end of the heating element, electrically insulating means between the heating element and the sheath, an internal lead pin electrically connected to the heating element and extending toward said end of the sheath, an electrically insulating end plug within said sheath at said end thereof held in a laterally compressed state by the sheath and having an opening in its inner face into which the outer end of said pin is received in generally closely fitting accommodation, and a hole in its outer face having its centerline offset from the centerline of said pin but laterally bounded in part by a lateral surface of said pin, and an external lead having an inner terminal, the hole in the end plug receiving the inner terminal of the external lead, the sheath being permanently deformed to a reduced cross sectional area when laterally compressed for increasing the compressive force it applies to the end plug, whereby, when the sheath is laterally compressed, the end plug holds said inner terminal and said internal lead pin in engagement with each other to form a lapped connection therebetween interiorly of the insulating end plug.

* * * * *

UNITED STATES PATENT AND TRADEMARK OFFICE

CERTIFICATE OF CORRECTION

PATENT NO. : 4,346,287

DATED : August 24, 1982

INVENTOR(S) : George B. Desloge

It is certified that error appears in the above—identified patent and that said Letters Patent is hereby corrected as shown below:

Column 3, line 13, "disclosed" should read -- directed --. Column 4, line 65, "head" should read -- lead --. Column 5, line 38, "plug 23 fills" should read -- plug 23 is held in a laterally compressed state in the sheath 7, fills --; line 44, "17 extend" should read -- 17 are received in closely fitting accommodation in the opening 25, 27, extend --. Column 10, line 61, "Contemplate" should read -- Contemplated --.

Signed and Sealed this

First Day of February 1983

[SEAL]

*Attest:*

GERALD J. MOSSINGHOFF

*Attesting Officer*

*Commissioner of Patents and Trademarks*